US005119724A

United States Patent [19]

Ng

[11] Patent Number: 5,119,724

[45] Date of Patent: Jun. 9, 1992

[54] FORCE ADJUSTMENT DEVICE IN A MANUAL PAD PRINTER

[75] Inventor: Hin-Chung Ng, Tuen Mun, Hong Kong

[73] Assignee: Tai Chung Metal Factory, Tuen Mun, Hong Kong

[21] Appl. No.: 684,282

[22] Filed: Apr. 12, 1991

[30] Foreign Application Priority Data

Jan. 9, 1991 [GB] United Kingdom ..... 2012213

[51] Int. Cl.[5] ..... B41F 17/00

[52] U.S. Cl. ..... 101/41; 101/104; 101/287

[58] Field of Search ..... 101/103, 109, 35, 41, 101/327, 333, 334, 318, 193, 287, 292, 42, 104

[56] References Cited

U.S. PATENT DOCUMENTS

| | | | |
|---|---|---|---|
| 1,657,237 | 1/1928 | Talbot | 101/41 |
| 2,777,385 | 1/1957 | Bachy | 101/42 |
| 3,094,926 | 6/1963 | Mintz | 101/318 |
| 4,163,421 | 8/1979 | Sihota | 101/41 |
| 4,314,504 | 2/1982 | Combeau | 101/41 |

FOREIGN PATENT DOCUMENTS

| | | | |
|---|---|---|---|
| 500080 | 4/1976 | U.S.S.R. | 101/41 |
| 269494 | 7/1927 | United Kingdom | 101/41 |

*Primary Examiner*—Edgar S. Burr
*Assistant Examiner*—Ren Yan
*Attorney, Agent, or Firm*—Fleit, Jacobson, Cohn, Price, Holman & Stern

[57] ABSTRACT

A pad printer device includes a base member (2), a table member mounted on the base member, a slide member (3) slidably mounted on the table member for movement between at least two positions, and a printing pad (17) supported on printing arm (16) mounted on a support block (15) slidably mounted in a box-like column (9) extending upwardly from base (1). Printing pad (17) is reciprocated vertically by lever-type arm (25) pivotally engaged (27, 28) with support block (15) so that operation of the arm reciprocates the printing pad vertically. An adjustable limit gauge device is mounted on slide block (15) and includes two separately operable set screws (30, 31) which separately engage with rotatable stop member (47) rotatably mounted on base member (1) for positioning thereof for engagement with the lower ends of the set screws. The stop member (47) is rotated by a cam (46) connected thereto through a cam sleeve (45) pivotally mounted on a cam shaft (43), the cam (46) having parts (48, 49) extending into the path of movement of a cam operator (40) mounted on sliding block (36) which is part of the slide assembly, so that reciprocation of slide assembly (3) in one direction rotates stop member (47) into position for engagement with the lower end of one of the gauge screws and operation of block (36) in the opposite direction rotates stop member (47) in the opposite direction for engagement with the lower end of the other gauge screw, so that the force applied by printing pad (17) is controlled, or standardized, for each operation thereof in either position of the slide assembly (3).

12 Claims, 5 Drawing Sheets

FORCE ADJUSTMENT DEVICE IN A MANUAL PAD PRINTER

BACKGROUND OF THE INVENTION

This invention relates to a manual pad printer, and more particularly to a force adjustment device for such a manual pad printer to control the amount of force applied to the image plate or printing object through the pad.

Manual pad printing devices have been known wherein a manually operated pad generally movable upwardly and downwardly is first moved downwardly to apply the printing pad to the image plate to absorb the printing ink from the image plate printing pad, whereafter the printing pad is raised and subsequently lowered onto the printing table which has been positioned beneath the pad to print the ink thereon onto an object on the printing table, after which the pad is raised again for repeating the same sequence of operations for printing another object. However, in prior art devices it is difficult to control the force applied to the image plate, or to the printing object, through the pad, so that this force is applied uniformly. Thus, the printing effect cannot be standardized.

BRIEF SUMMARY OF THE INVENTION

It is an object of the present invention to provide a manually operated pad printer which overcomes the above problem by controlling the force applied to the image plate, or the printing object.

It is a further object of this invention to provide an improved manually operated pad printer having an adjustable gauge device integral therewith to control the force applied to the image plate, or the printing object through the pad.

It is another object of the invention to provide a manual pad printer having a force control device thereon for effecting uniform force on to the image plate and printing object so that the printing effect is standardized.

The above objects are achieved in the instant invention wherein a base member having a slide assembly slidably mounted thereon has an upstanding column supported on the rear side of the base member adjacent the slide assembly, and a printing pad slidably mounted on the column for reciprocating vertical movement for selective engagement with an image plate and a printing table mounted on the slide assembly when the latter is shifted from the position for engagement of the printing pad with the image plate and for engagement with the object to be printed on the printing table. A gauge plate is mounted on the device to move with the printing pad support arm and has threadedly engaged therewith a pair of elongated set screws, or gauge screws extending substantially vertically. A stop member is rotatably mounted on the base member for oscillating rotational movement into positions for alternately engaging the lower end of one of the gauge screws to limit the downward movement of the printing pad and thereby control the force applied thereby. The stop member is rotated by a cam assembly interengaged therewith and operated to shift the stop member into the appropriate position in response to reciprocating movement of the slide assembly.

BRIEF DESCRIPTION OF THE DRAWINGS

The invention will now be described in detail with reference to the accompanying drawings, wherein.

DETAILED DESCRIPTION

Figure 1:
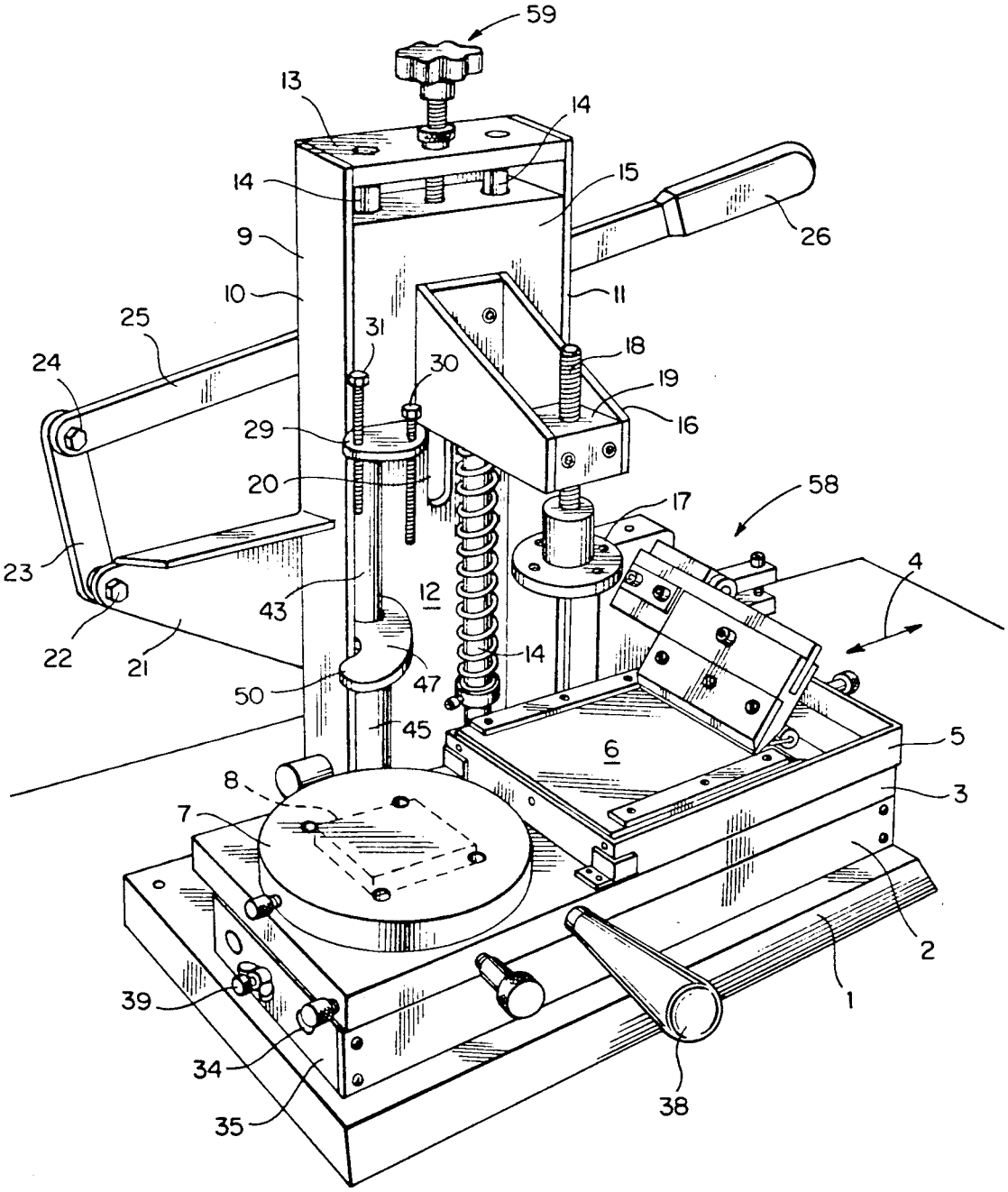
FIG. 1 is a perspective view of the manual pad printer of this invention showing the printing pad in a raised position.

With reference to the drawings, FIG. 1 shows a perspective view of the invention wherein a base member 1 has mounted thereon a table member 2 on which is slidably mounted a slide assembly 3 (hereafter "slide") for sliding movement in the longitudinal direction of the table shown generally by arrow 4. The details of the slidable mounting of slide assembly 3 on table 2 will be described hereinbelow. On one part of slide 3 is image plate assembly 5 which contains the printing ink in the area indicated at 6. On the other part of slide 3 is printing table 7 on which the object 8 to be printed is supported.

On the rear part of base 1 is mounted, by suitable means such as welding or screw fasteners, an upstanding column 9 of generally channel shape having two sides 10, 11, rear sid top end 13. Guide rods 14 extend upwardly in the vertical direction of column 9 and are connected at their upper ends to end 13 and at their lower ends in base member 1. Printing pad mounting block 15 is slidingly mounted within column 9 on guide rods 14 for vertical movement, and has printing pad arm 16 mounted thereon, such as by welding or suitable fastening means, and extending outwardly therefrom into the area over slide 3 and the image plate assembly and printing table thereon. Printing pad 17 is mounted on the outer end of arm 16 for vertical adjustment by means of a screw threaded shaft 18 extending from the upper part thereof through an internally threaded bore in block 19 mounted in arm 16 by screws or bolts. Rear side 12 of column 9 has guide slot 20 therein for a purpose which will later be explained.

Figure 2:
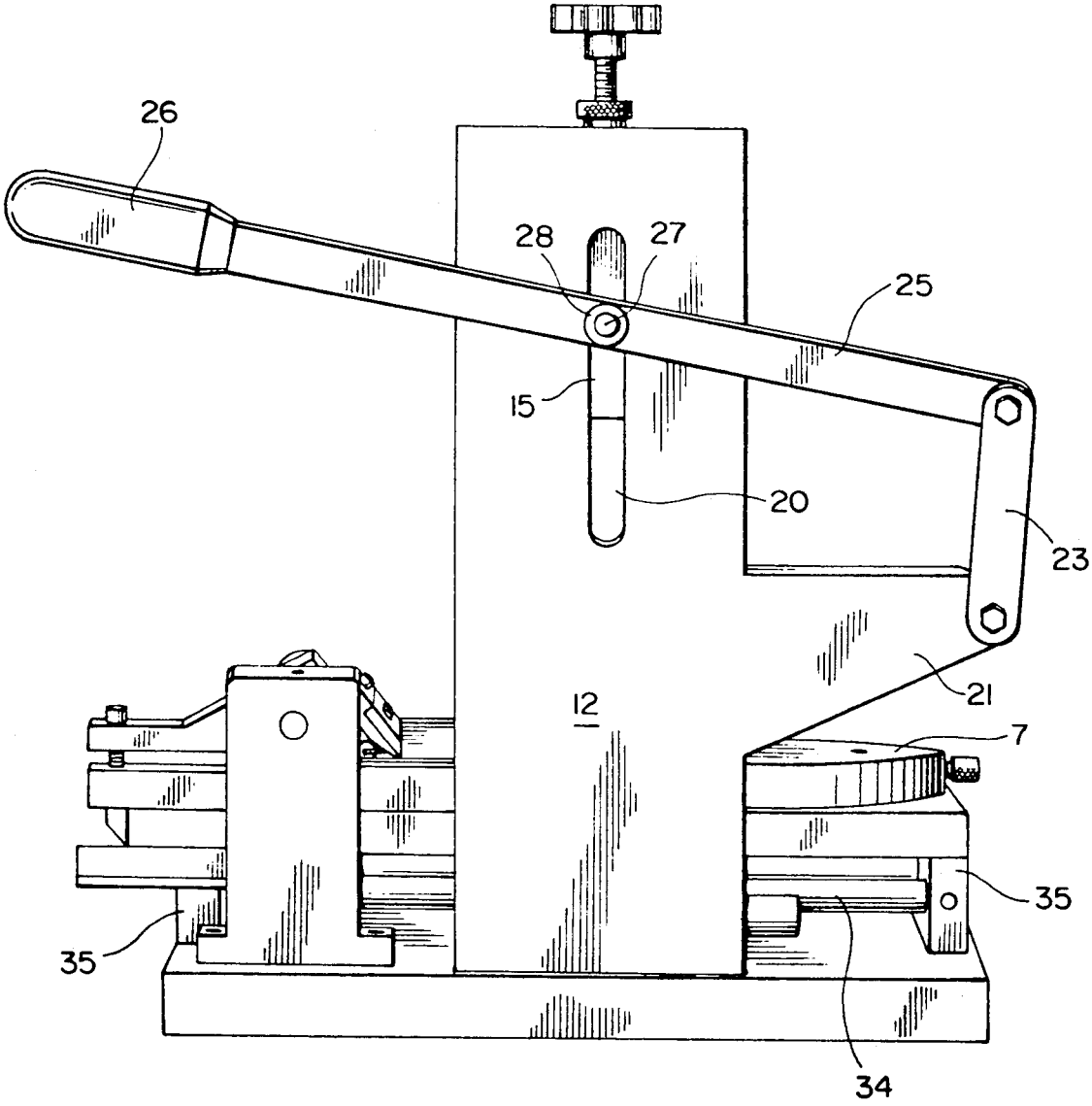
FIG. 2 is a rear perspective view of the device of FIG. 1.

Extending outwardly from column 9 to the left as shown in FIG. 1 is support arm 21 to which is pivotally connected at 22 link 23 which is also connected pivotally at 24 to one end of operating arm 25. The other end of operating arm 25 has handle 26 thereon. Between its ends arm 25 is pivotally connected to mounting block 15, as more clearly shown in FIG. 2, by a shaft or pin member 27 mounted in block 15 and extending through guide slot 20 to pivotally engage with arm 25 by a suitable bearing means 28. Thus, members 21, 22, 23, 24, 25, 26, 27, and 28 form a toggle arm assembly for reciprocally operating sliding block 15 and printing pad 17 thereon vertically.

A gauge plate 29 is mounted on mounting block 15, by suitable means such as welding or screw fasteners (not shown) and has threadedly engaged therein in spaced relation gauge screws 30 and 31 having heads at their upper ends for turning the gauge screws for adjusting their relative positions in threaded bores in gauge plate 29 for a purpose which will appear below. Gauge plate 29 could alternatively be mounted on arm 16.

Figure 4:
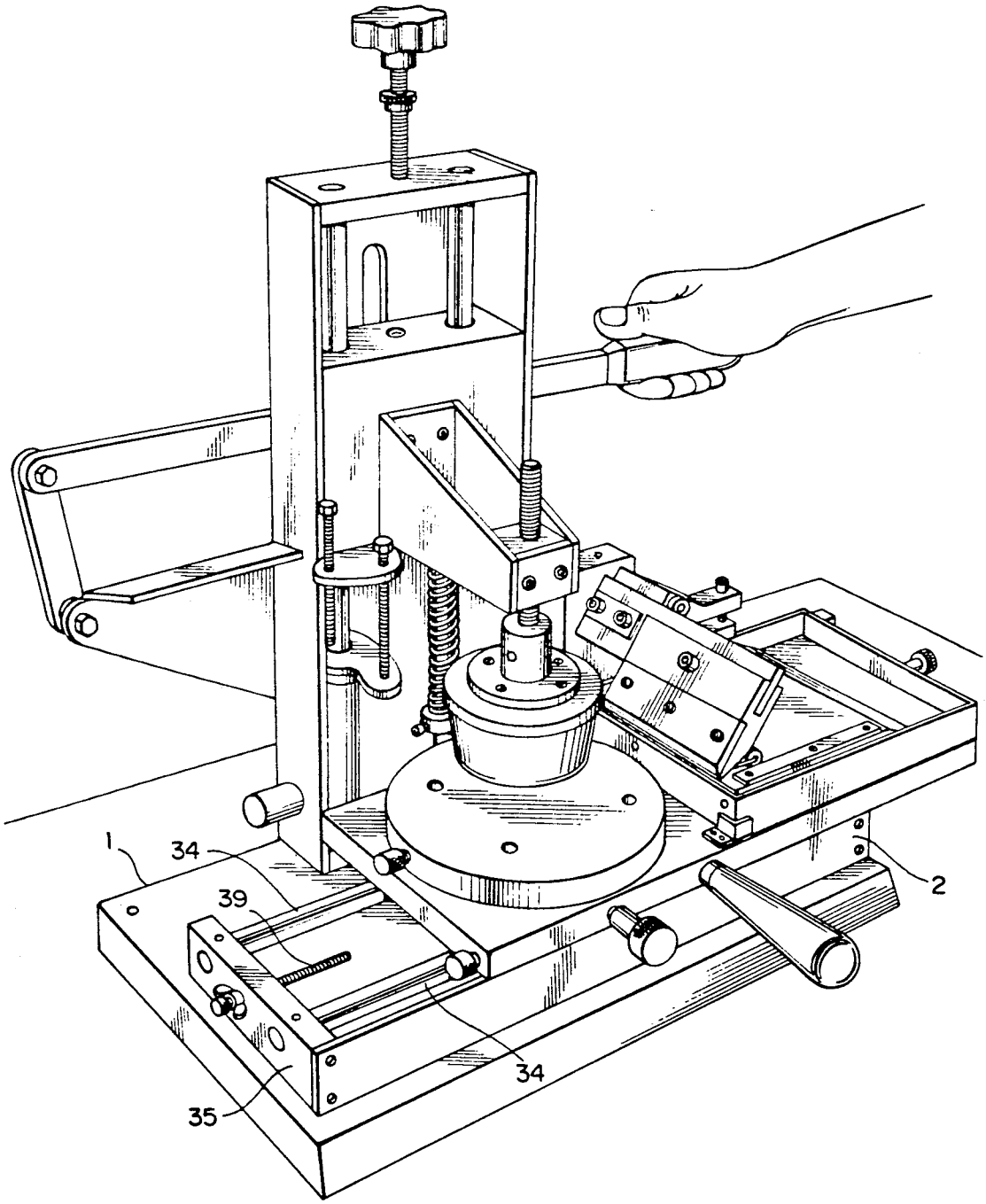
FIG. 4 is a view similar to FIG. 1 showing the printing pad lowered to engage the object to be printed after the slide has been moved to the right.
Figure 5:
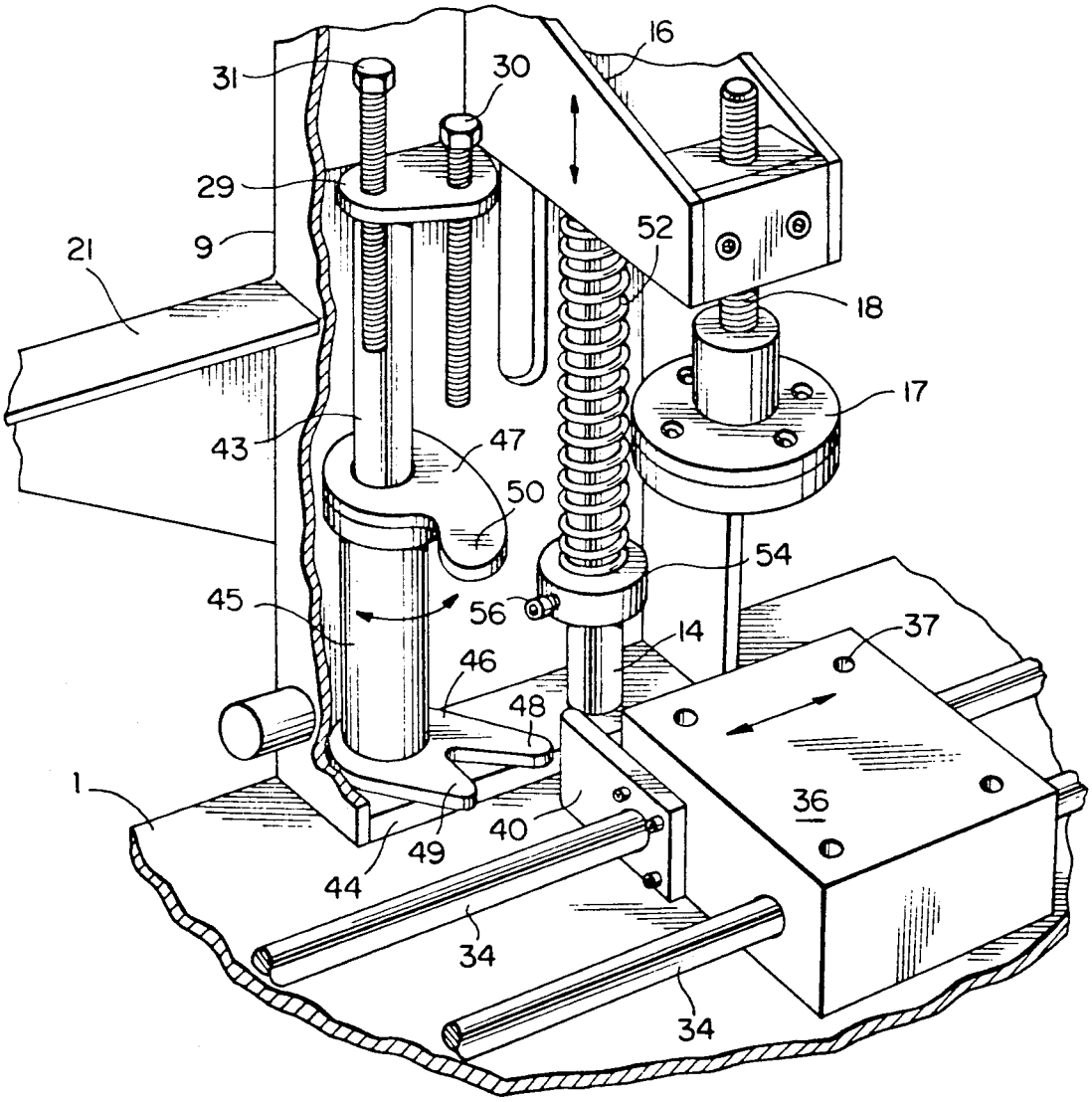
FIG. 5 is an enlarged perspective view of part of the device of FIG. 1 with parts omitted to show details of the force control device of the invention.

The details of slide assembly 3 and the force control features will now be described. Within table 2, which is hollow, are mounted two parallel guide shafts 34, shown in FIG. 4 which shows the slide assembly shifted to the right, or printing position. Guide shafts 34 are mounted at each end thereof in opposite ends 35 of table 2. Slide mounting block 36 as shown in FIG. 5 is slidably mounted on guide shafts 34 for sliding movement thereon. Slide 3 is supported on mounting block 36 by suitable fasteners, for example, such as screws or bolts (not shown) engageable in threaded bores 37 in block 36. Handle 38 is provided on slide 3 for manually transferring or shifting slide 3 between the operating positions of the machine, as will be understood in the further description herein. Set screws 39 are provided in ends 35 to function as stops to limit the movement of mounting block 36. A cam operator 40 is mounted on block 36 as shown in FIG. 5 by screw type fasteners 41, for example, and is provided with a bore 42 through which one of the guide shafts 34 passes without interference. Cam operator 40 in the embodiment illustrated is in the form of a plate which extends beyond the rear side of block 36 in the direction of column 9. A vertical cam shaft 43 is mounted at its lower end in the bottom 44 of column 9 and could extend into base member 1. A cam sleeve 45 is rotatably mounted coaxially on shaft 43 and has mounted non-rotatably on the lower end thereof cam 46 and non-rotatably mounted on the upper end thereof stop plate 47 so that elements 46 and 47 rotate together with sleeve 45. Cam 46 has two cam operator extensions or fingers 48, 49 thereon between which is a cutout or groove portion. Finger extensions 48 and 49 extend into the path of movement of the rear edge of cam operator 40 so that when slide block 36 is shifted along guide rods 34 the rear edge of cam operator 40 will engage cam fingers 48 and 49 and within the groove therebetween to operate cam 46 to rotate sleeve 45 and thereby stop plate 47 about the axis of shaft 43. More specifically, cam finger 48 may be longer than cam finger 49, with respect to the rotational axis of shaft 43 and sleeve 45. When cam operator plate 40 moves to the left, as shown in FIG. 5, it engages cam finger 49 and rotates sleeve 45 and stop plate 47 clockwise, and when cam operator plate 40 is shifted to the right, it engages cam finger 48 and rotates sleeve 45 and stop plate 47 counterclockwise, thereby positioning stop plate 47 to engage alternately the lower end of either gauge screw 30, or 31. Stop plate 47 has a planar disc shape with extension or finger 50 extending outwardly therefrom so that it is engageable with the lower ends of gauge screws 30 and 31.

The operation of the pad printer of this invention will now be described.

Figure 3:
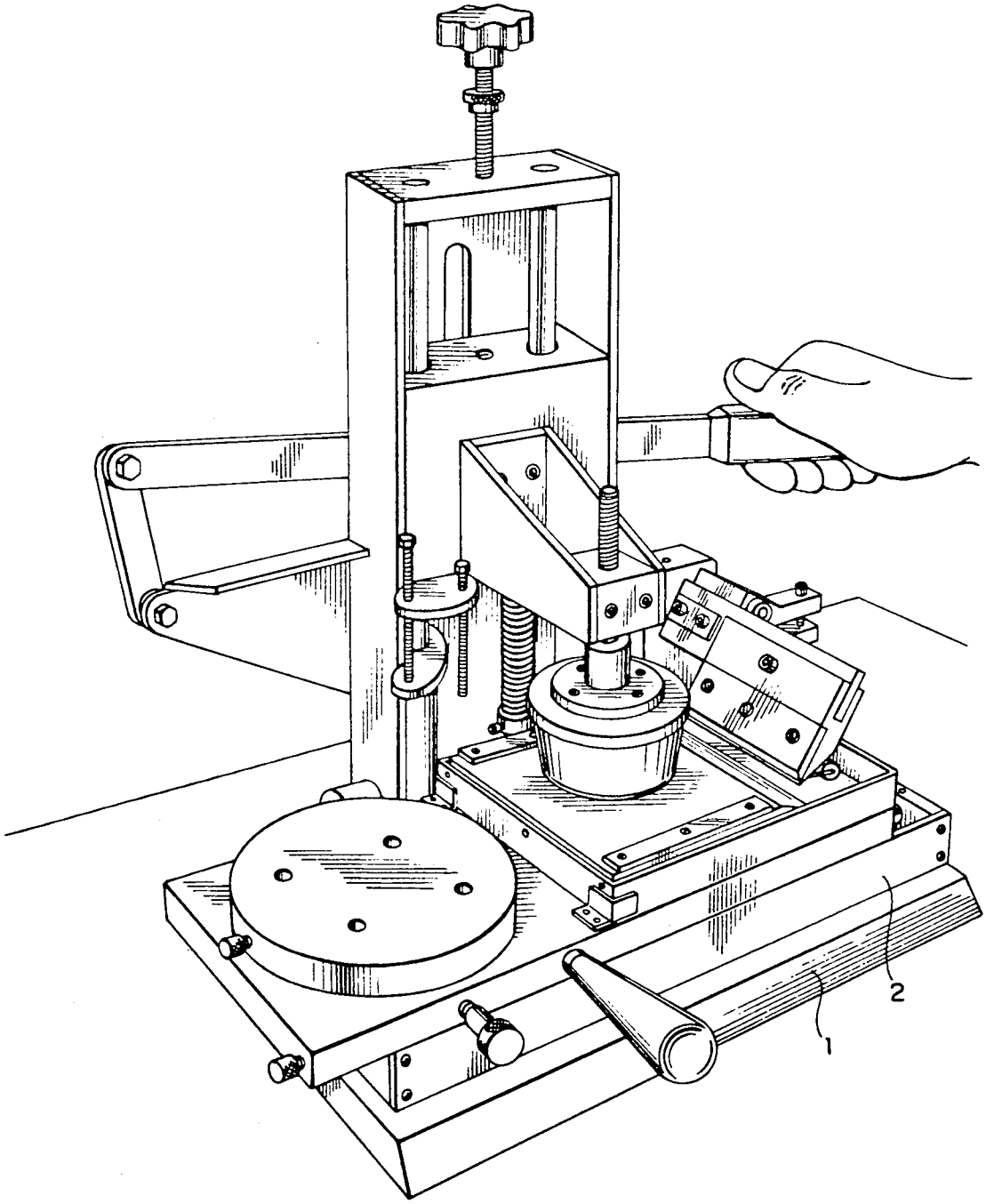
FIG. 3 is a view similar to FIG. 1 showing the printing pad lowered to engage the mold plate.

FIG. 1 shows the device with the handle 26 in the raised position to raise printing pad 17 to the neutral position above table 2 and slide 3. Slide 3 is shown approximately in a neutral position. In this position, or in a position where slide 3 is moved slightly to the left, as shown in FIG. 3, slide mounting block 36 and cam operator 40 thereon have moved to the left to engage cam leg 49 and rotate stop plate 47 clockwise into position for engagement with the lower end of gauge screw 31 for limiting further downward movement of arm 16. When slide 3 is adjusted to position image plate assembly 5 and the printing ink area 6 thereon directly under printing pad 17, arm 25 is pushed downwardly to lower printing pad 17 onto area 6, as shown in FIG. 3, where printing pad 17 picks up the the printing ink form the surface 6, after which arm 25 is again raised to raise printing pad 17 off of surface 6 so that slide 3 can be transferred to the printing position. FIG. 4 shows the printing position wherein slide 3 has been moved to the right to position printing table 7 directly below printing pad 17. With the sliding of slide 3 to the right with block 36, cam operator 40 engages finger 48 of cam 46 and rotates sleeve 45 and stop plate 47 counterclockwise so that extension 50 on stop plate 47 is directly beneath gauge screw 30 so that it will engage the lower end of said screw 30 to limit movement of arm 16 when the printing pad is lowered into the printing position. With transfer slide 3 in this position, arm 25 is operated to lower printing pad 17 onto object 8 positioned on the top of printing table 7 for performing a printing operation thereon. The set screws 30, and 31 are previously adjusted into predetermined positions to limit the downward movement of slide block 15 and arm 16 and thereby the amount of force applied by the printing pad 17 on the surface 6 and on the object 8 to be printed, respectively, by engagement of the lower ends of the gauge screws with stop plate 47. Thus, with the gauge screws 30 and 31 preset in the desired positions, the amount of force applied by pad 17 will always be the same during repeated use of the device to perform the printing operations. In other words, with the invention the force applied by the printing pad 17 is positively controlled so that the printing operation is standardized for continuous use on a plurality of objects 8.

Coil spring 52 is provided around guide rod 14 and engages at its upper end arm 16, or block 15, and at its lower end adjustable stop collar 54 which has set screw 56 thereon for engaging shaft 14 to fix collar 54 in a position to compress spring 52 a desired amount to return, or assist in returning, arm 16 and printing pad 17 to the raised position.

Generall at 58 is a wiper assembly for treating the surface 6 of image plate 5.

I claim:

1. A pad printer device comprising:

a base member having a front side, a rear side and top surface;

a table member mounted on said top surface of said base member and having a front side, a rear side and opposite ends;

a slide assembly slidably mounted on said table member for movement relative to said base member;

an upstanding column having a lower end mounted on said base member adjacent the rear side thereof, an upper end, an open front side, a rear side and two spaced opposing sides extending from said rear side of said column, so that said column is substantially box shaped having a hollow interior;

a plurality of guide rods extending upwardly through the interior of said column, each guide rod having a lower end mounted in said lower end of said column and an upper end mounted in said upper end of said column;

a printing pad support block slidably mounted on said guide rods for reciprocal substantially vertical movement on said column;

a printing pad support arm connected to and extending from said printing pad support block over said slide assembly;

an outer end on said printing pad support arm displaced from said printing pad support block;

a printing pad mounted on said outer end of said support arm and having a pad portion facing downwardly towards said slide assembly;

printing pad operating means connected to said printing pad support block for moving said printing pad support block reciprocally on said column;

image plate means mounted said slide assembly;

printing table means mounted on said slide assembly adjacent said image plate means;

means for moving said slide assembly reciprocally to selectively position one of said image plate means and printing table means directly under said printing pad for engagement thereby;

gauge plate means mounted on said printing pad support block for reciprocating movement therewith;

two gauge screws threadedly engaged and separately operable in said gauge plate means for adjustment relative to said base member;

stop means rotatably mounted on said base member into respective positions for engagement with said respective gauge screws for limiting downward movement of said printing pad, respectively;

cam operating means connected to said slide assembly for movement therewith; and cam means rotatably mounted on said base member for engagement by said cam operating means and interconnected with said stop means, so that when said slide assembly is moved into the position wherein said image plate means is beneath said printing pad said cam operating means engages said cam means and rotates said cam means and said stop means into position for engagement of said stop means by one of said gauge screws, and when said slide assembly is moved in the opposite direction to position said printing table means beneath said printing pad, said cam operating means engages said cam means and rotates said cam means in the opposite direction to rotate said stop means into position for engagement by the other of said gauge screws.

2. A pad printer device as claimed in claim 1 wherein said cam means comprises:

a cam shaft having one end mounted in said lower end of said column and extending upwardly therefrom;

a cam sleeve coaxially and rotatably mounted on said cam shaft and having upper and lower ends said stop means being connected to said upper end of said cam sleeve; and a cam plate on said lower end of said cam sleeve engageable by said cam operating means for rotating said cam sleeve and stop means thereon in response to said movement of said slide assembly.

3. A pad printer device as claimed in claim 2 wherein said cam plate comprises:

a central part;

two spaced cam fingers extending from said central part; and a groove between said fingers for receiving said cam operating means, so that said fingers independently engage said cam operating means.

4. A pad printer device as claimed in claim 1 wherein said stop means comprises:

a disc member having a central part and a stop part extending therefrom for separate and independent engagement by one of said gauge screws.

5. A pad printer device as claimed in claim 2 wherein said stop means comprises:

a disc member having a central part and a stop part extending therefrom for separate and independent engagement by one of said gauge screws.

6. A pad printer device as claimed in claim 3 wherein said stop means comprises:

a disc member having a central part and a stop part extending therefrom for separate and independent engagement by one of said gauge screws.

7. A pad printer device as claimed in claim 1 wherein:

said slide assembly comprises a plurality of substantially horizontal guide rods mounted on said table member, a slide block slidingly and guidingly mounted on said horizontal guide rods and having a rear side, and a slide plate mounted on said slide block; and said cam operating means comprises a plate member connected to said slide block and having a cam means engaging part extending outwardly of said rear side of said slide block.

8. A pad printer device as claimed in claim 2 wherein:

said slide assembly comprises a plurality of substantially horizontal guide rods mounted on said table member, a slide block slidingly and guidingly mounted on said horizontal guide rods and having a rear side, and a slide plate mounted on said slide block; and said cam operating means comprises a plate member connected to said slide block and having cam means engaging part extending beyond said rear side of said slide block.

9. A pad printer device as claimed in claim 3 wherein:

said slide assembly comprises a plurality of substantially horizontal guide rods mounted on said table member, a slide block slidingly and guidingly mounted on said horizontal guide rods and having a rear side, and a slide plate mounted on said slide block; and said cam operating means comprises a plate member connected to said slide block and having a cam means engaging part extending outwardly of said rear side of said slide block.

10. A pad printer device as claimed in claim 4 wherein:

said slide assembly comprises a plurality of substantially horizontal guide rods mounted on said table member, a slide block slidingly and guidingly mounted on said horizontal guide rods and having a rear side, and a slide plate mounted on said slide block; and said cam operating means comprises a plate member connected to said slide block and having a cam means engaging part extending outwardly of said rear side of said slide block.

11. A pad printer device as claimed in claim 5 wherein:

said slide assembly comprises a plurality of substantially horizontal guide rods mounted on said table member, a slide block slidingly and guidingly mounted on said horizontal guide rods and having a rear side, and a slide plate mounted on said slide block; and said cam operating means comprises a plate member connected to said slide block and having a cam means engaging part extending outwardly of said rear side of said slide block.

12. A pad printer device as claimed in claim 6 wherein:

said slide assembly comprises a plurality of substantially horizontal guide rods mounted on said table member, a slide block slidingly and guidingly mounted on said horizontal guide rods and having a rear side, and a slide plate mounted on said slide block; and said cam operating means comprises a plate member connected to said slide block and having a cam means engaging part extending outwardly of said rear side of said slide block.

* * * * *